US006428153B1

(12) United States Patent
Hsu et al.

(10) Patent No.: US 6,428,153 B1
(45) Date of Patent: Aug. 6, 2002

(54) INK PRESSURE ADJUSTMENT DEVICE FOR INKJET PEN

(75) Inventors: Cheng-Wei Hsu, Tainan; Shyh-Haur Su, Hsinchu; I-Chung Hou, Hsinchu; Chieh-Wen Wang, Hsinchu; Yuan-Liang Lan, Hsinchu, all of (TW)

(73) Assignee: Industrial Technology Research Institute (TW)

( * ) Notice: Subject to any disclaimer, the term of this patent is extended or adjusted under 35 U.S.C. 154(b) by 41 days.

(21) Appl. No.: 09/861,533

(22) Filed: May 22, 2001

(30) Foreign Application Priority Data

Feb. 1, 2001 (TW) ..... 90101982 A

(51) Int. Cl.[7] ..... B41J 2/175
(52) U.S. Cl. ..... 347/85
(58) Field of Search ..... 347/85, 86, 87, 347/92, 94; 222/386.5, 105

(56) References Cited

U.S. PATENT DOCUMENTS 5,409,134 A 4/1995 Cowger et al. ..... 222/1
5,505,339 A 4/1996 Cowger et al. ..... 222/105
5,526,030 A 6/1996 Baldwin et al. ..... 347/87
5,600,358 A 2/1997 Baldwin et al. ..... 347/87
5,975,686 A * 11/1999 Hauck et al. ..... 347/85
5,988,803 A * 11/1999 Komplin et al. ..... 347/86

* cited by examiner

*Primary Examiner*—Michael Nghiem

(57) ABSTRACT

The present invention is an ink pressure adjustment device of inkjet pen; the device is utilized to adjust negative pressure in an ink cartridge mainly through an expandable and shrinkable gasbag installed in the ink cartridge, and a tension valve attached on the surface of the gasbag. The tension valve can open or close automatically an air hole that communicates atmosphere and the inner part of ink cartridge via the gasbag according to the expansion and shrinkage of the gasbag, causing a part of atmosphere to enter the ink cartridge so as to adjust the negative pressure of the ink cartridge and not only can prevent ink from leaking but also prevent the negative pressure from being too large to fail the inkjet printing.

13 Claims, 5 Drawing Sheets

INK PRESSURE ADJUSTMENT DEVICE FOR INKJET PEN

TECHNICAL FIELD

The present invention relates to a pressure adjustment device, more particularly to a pressure adjustment device, which can adjust the negative pressure inside the ink cartridge timely so as to prevent ink from leaking and prevent inkjet print from not working owing to excess negative pressure.

BACKGROUND OF THE PRESENT INVENTION

Drop-on-demand is a generally used method to control ink to output from an ink storage tank to a recording media (such as printing paper) in a conventional inkjet printing. The traditional inkjet pen, which uses drop-on-demand, is generally furnished with hot bubble type or piezoelectric force wave type printing head. The main element of hot bubble type printing head is a thin film resistance, when is heated, a trace of ink drops can be evaporated instantly, fast expansion after evaporation of ink drops cause little ink to pass the injection exit of the printing head again to spray and print onto a printed paper. Although the printing head of drop-on-demand can get ink from the ink storage tank in the inkjet pen effectively to spray ink drops, but drop-on-demand needs a control function to make sure that ink does not leak out of the printing head when the printing head is not working. That such kind of control function stops ink to leak from the printing head is attained by generating a slight negative pressure in the ink storage tank. What is called negative pressure indicates that a part of vacuum is formed in the ink storage tank, it is shown as a positive value as measuring negative pressure, so the increase in negative pressure means the increase of vacuum degree. Ink can be stopped to leak out of the printing head by increasing negative pressure.

Although ink can be stopped to leak out of the printing head by increasing negative pressure, but negative pressure cannot be too large, otherwise it will cause the printing head to be unable to overcome negative pressure and make ink drops to be unable to spray out. Another, the negative pressure in the ink storage tank of the inkjet pen must be able to be adjusted as surrounding pressure changes so as to be kept in an appropriate range. Such as, when the surrounding pressure lowers, the negative pressure for stopping ink to leak out of the printing head is increased relatively. Besides, the "operation effect" of the ink storage tank may also affect the negative pressure in the ink storage tank, such as, when the ink in the ink storage tank is consumed continuously; it will cause the negative pressure in the ink storage tank to increase. If the negative pressure is not adjusted appropriately, the printing head is affected gradually by too large negative pressure to change the dimension of the sprayed-out ink drop. It not only influences the printing quality, but also even cannot spray out ink completely at last.

The known pressure adjustment technology, such as the U.S. Pat. Nos. 5,409,134 and 5,505,339 have already revealed an adjuster for adjusting the negative pressure in the ink storage tank. Such kind of adjuster generally is a elastic gasbag the principle it uses is to let the volume of the ink storage tank and the change of the negative pressure be adjusted by the variation of the occupied volume of the elastic gasbag in the ink storage tank. For an example, when surrounding pressure lowers, the negative pressure in the inkjet pen relative to surrounding environment is also lowered. At that time, the adjuster begins to work (the elastic gasbag shrinks) to increase the volume of the ink storage tank so as to increase the negative pressure to prevent ink from leaking. On the contrary, when surrounding pressure arises or the negative pressure in the ink storage tank increases owing to the consumption of ink, this elastic gasbag will expand to lower the negative pressure slightly to prevent ink from leaking. Therefore, such kind of adjuster has an ability of two-ways adjustment of the pressure change.

Although these elastic-gasbag-type adjuster can adjust the negative pressure in the ink storage tank successfully, but in general, the maximum expansion of the elastic gasbag has its own limit, therefore when ink is consumed to a certain extent, the volume of the ink storage tank cannot be changed any more for the reason that the elastic gasbag has already reach the maximum expansion, the result that ink reduces continuously will cause the negative pressure to be too large and to exceed the proper range, therefore, the printing head cannot overcome the negative pressure so that it will cause ink drops to be unable to spray out, and so, ink in the ink storage tank cannot be consumed completely.

Another known pressure adjuster of the inkjet pen is called "bubble generator", such as the U.S. Pat. Nos. 5,526,030 and 5,600,358. The bubble generator has a nozzle, the ink storage tank communicates with atmosphere via the nozzle. After the dimension of the nozzle is decided appropriately, ink can gather around in the nozzle and constructs a fluid-type seal through capillary force. When the negative pressure is too large, surrounding air will enter into ink storage tank as bubble type, this will cause the negative pressure in the ink storage tank to be lowered. When the negative pressure lowers to a certain extent, the force entering bubble will be smaller than the capillary force so as to rebuild the fluid-type seal to stop bubble to enter no more. However, such kind of pressure adjuster only can adjust pressure variation one way, this is to say, when surrounding pressure lowers, the pressure adjuster will not work, this will cause ink to leak from the nozzle. Besides, the bubble generator control the negative pressure of the ink storage tank through capillary effect between gaps, this will cause that gaps must be controlled precisely, and such kind of the requirement will increase the difficulty of manufacturing and installment. If ink dries at the nozzle, it will cause the pressure adjuster to lose efficacy.

SUMMARY OF THE INVENTION

The main object of the present invention is to provide an ink pressure adjustment device for inkjet pen, preventing the negative pressure inside an ink cartridge of an inkjet pen from being too large.

Another object of the present invention is to provide an ink pressure adjustment device for inkjet pen, which doesn't occupy space, the manufacturing cost thereof is low, the installment thereof is easy and the negative pressure of an ink cartridge can be two-ways adjusted.

The pressure adjustment device reveal a tension valve attached to the surface of the gasbag, this tension valve can operate in coordination with the expansion and shrinkage movements of the gasbag, opens or closes timely an air hole disposed at the surface of the gasbag for communicating atmosphere and the inner part of the ink cartridge by way of the gasbag, particularly before the negative pressure value increase to an extent that the printing head cannot spray out ink, the tension has already open the air hole, part of atmosphere (air) will enter the ink cartridge form the tension valve at that time (probably as a type of bubble), so as to prevent the negative pressure in the ink cartridge from increasing too high to lead to a result that inkjet printing doesn't work.

In a preferred embodiment of the present invention, the tension valve is made of rubber or other similar materials and is a thin plate element with a slit therein. It is attached on the surface of the gasbag, the curving extent of surface deformation at the gasbag expansion may decide to open or close the tension valve. That the negative pressure in the ink cartridge is higher means the expansion degree of the gasbag increases (it also means that the occupied volume of the gasbag in this ink cartridge increases), the expanding gasbag will open the slit that is attached on the surface of the tension valve owing to the deformation of the surface thereof so as to cause part of atmosphere (air) enter the ink cartridge through this slit to adjust the negative pressure in the ink cartridge.

In another preferred embodiment of the present invention, a tension valve even can replace the spring used in the traditional elastic gasbag, a thin plate type tension valve made of rubber and other similar material is attached on the most parts of the surface of the gasbag, it can provide a proper shrinking force to restrain the expansion of the gasbag through the elasticity of rubber itself and plasticity thereof so as to reduce the occupied volume of the gasbag in the ink cartridge, this is just like the traditional technology to press the gasbag by spring to provide the needed negative pressure.

The detailed description of the present invention and embodiments accompanying the drawings will be described as following.

DETAILED DESCRIPTION OF THE PREFERRED EMBODIMENT

Figures 1A, 1B:
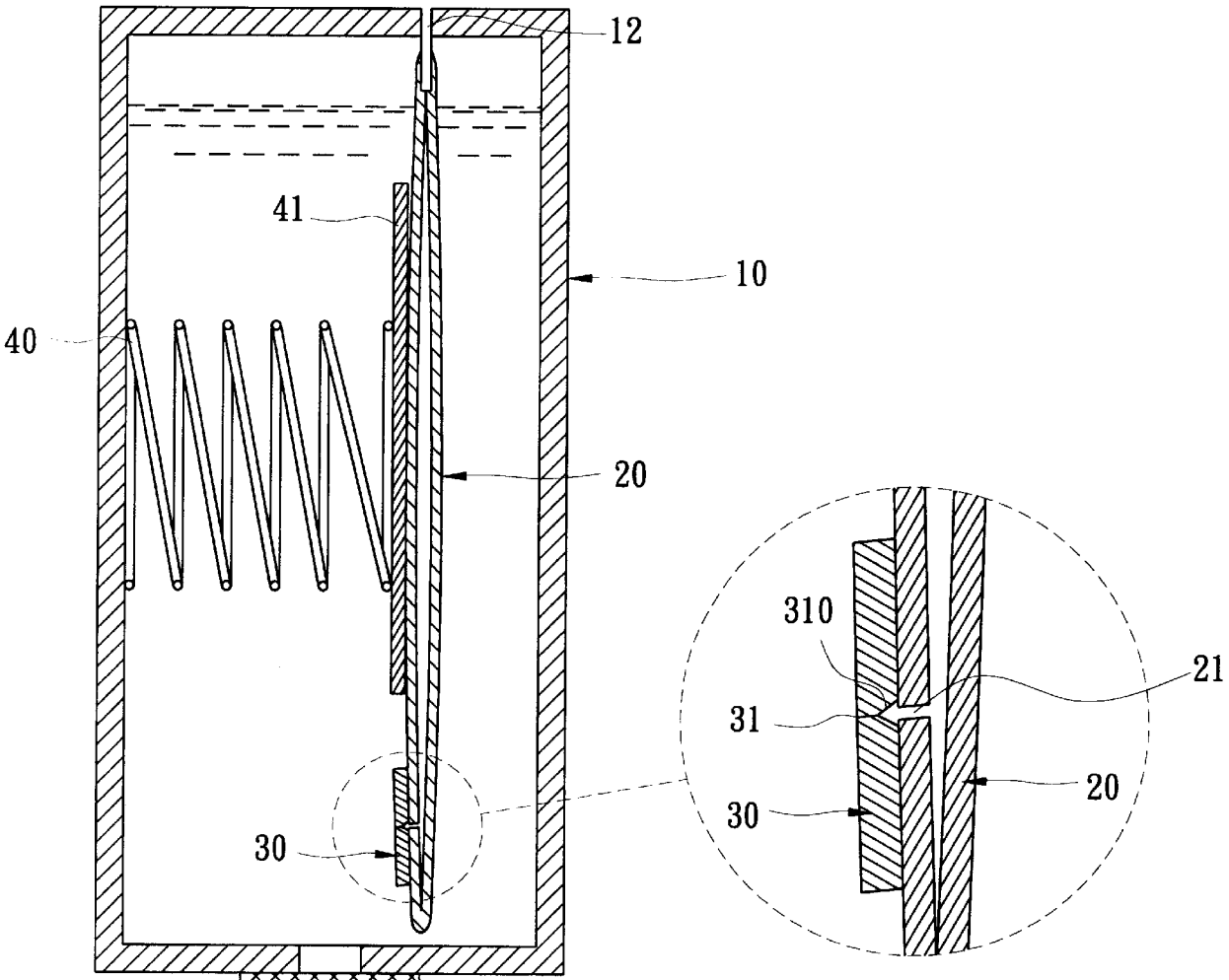
FIGS. 1A~1B is a cross sectional view of a preferred embodiment of the present invention, showing a structure of a pressure adjustment device in an ink cartridge of an inkjet pen when a tension valve isn't opened.

First, please referring to FIGS. 1A~1B, needed ink of an inkjet pen or inkjet printing facilities is received in an ink cartridge 10, an inkjet printing head 11 is installed to the bottom of the ink cartridge 10, which is a hot bubble type or piezoelectric type, and is utilized to spray the ink stored in the ink cartridge 10 onto record media such as normal paper or other similar stuff.

A pressure adjuster of the present invention comprises a gasbag 20, a tension valve 30 and an elastic element 40. The gasbag 20 is installed in the ink cartridge 10, the inner part of the gasbag 20 communicates with atmosphere via an air hole 12 disposed at the wall of the ink cartridge 10, and at least one another air hole 21 is further disposed at a surface of the gasbag 20 to communicate the gasbag 20 with the inner part of the cartridge 10. The tension valve 30 is attached to the surface of the gasbag 20 and is utilized to control the opening and closing of the above-mentioned air hole 21. The elastic element, such as spring or other similar elements, is utilized to provide a resistance force to the gasbag 20 when it is expanding, and generates needed negative pressure in the ink cartridge 10 by lowering the volume occupied by the gasbag 20 in the ink cartridge 10. In a preferred embodiment of the present invention, the elastic element 40 is a spring, one end thereof presses against the ink cartridge 10, another end thereof is fixed to a plate 41, it generates needed negative pressure (vacuum degree) in the ink cartridge 10 by pressing the gasbag 20 via the plate 41 through the elastic force of the elastic element 40 and by lowering the volume occupied by the gasbag 20 in the ink cartridge 10.

The structure of the gasbag 20 must be guaranteed to have a curved surface after it is expanded. Therefore, folding the two pieces of waterproof thin films together, and then sealing or melting circumferential edge together can make the gasbag 20. And the tension valve 30 is then tightly attached on the surface of the gasbag 20, it can be opened by the curved surface formed after the gasbag 20 is expanded to deform.

Figures 2A, 2B:
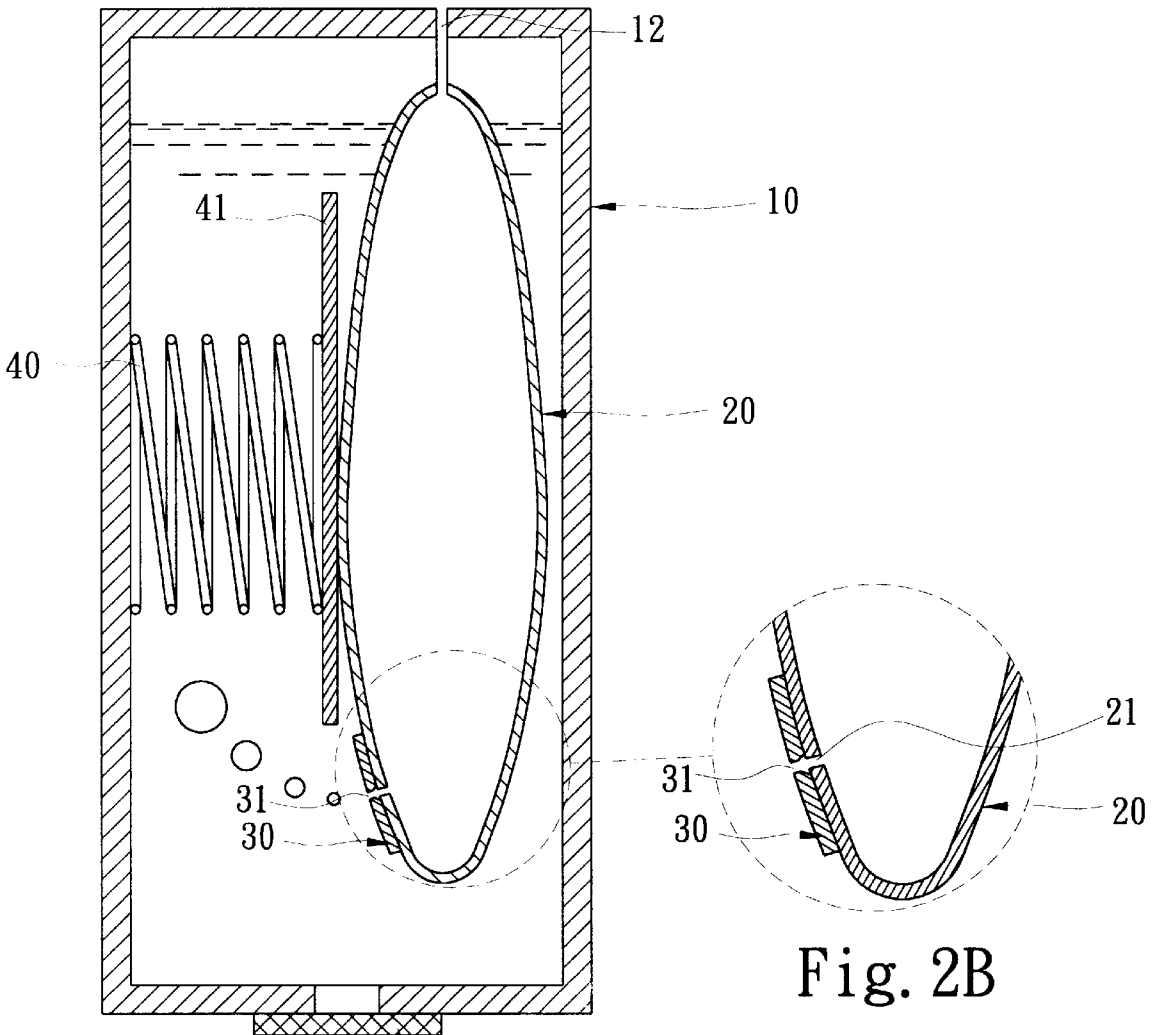
FIGS. 2A~2B is a cross sectional view of a preferred embodiment of the present invention, showing a structure of a pressure adjustment device in an ink cartridge of an inkjet pen when a tension valve is opened.

The tension valve 30 is a thin film shape element and can be made of such as rubber or other similar materials. The tension valve 30 is kept flat in a normal condition. The tension valve 30 has a slit 31, which is pierced through it completely. This slit 31 is kept completely closed when the tension valve 30 is kept flat in a normal condition, as shown in FIG. 1B. On the other hand, this slit 31 will be opened when the surface of the gasbag 20 is deformed to curve, the both front and rear sides of the tension valve 30 can communicate each other via this slit 31 at that time, as shown in FIGS. 2A~2B, the inner part of the ink cartridge 10 will communicate with the inner part of the gasbag 20 via the air hole 21, so that a part of atmosphere will pass the inner part of the gasbag 20 and then enter the inner part of the ink cartridge 10 via the air hole 21 so as to lower the negative pressure (vacuum degree) in the inner part of the ink cartridge 10, and to prevent the negative pressure in the inner part of the cartridge from being too high to fail the inkjet printing.

Figure 3A:
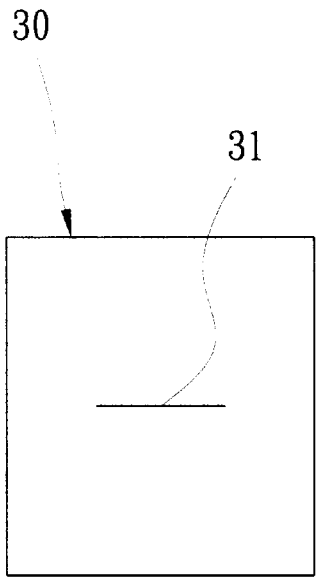
FIGS. 3B and 3C are diagrams of a preferred embodiment of the present invention, showing three shapes of slits of different tension valves.
Figure 3B:
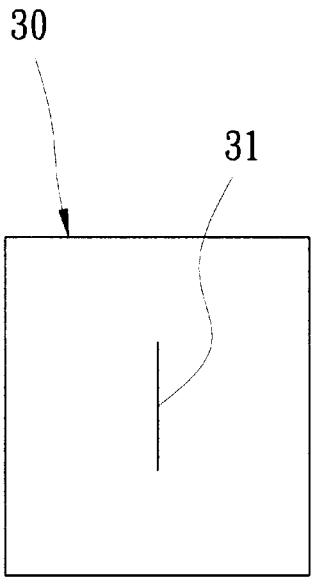
Figure 3C:
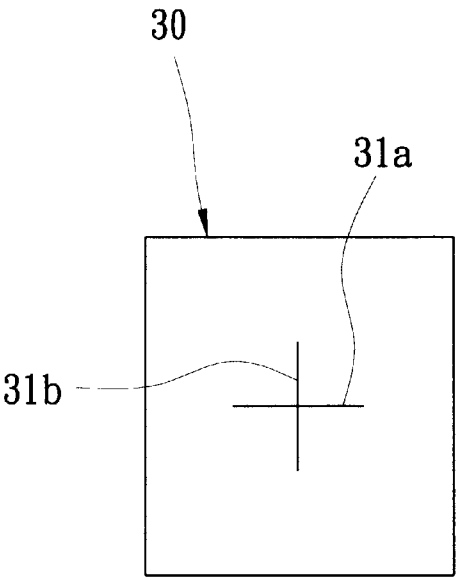

The slit 31 of the tension valve can be a single straight-line type slit, as shown in FIGS. 3A and 3B, and can also be several slits 31*a* and 31*b* that cross each other, as shown in FIG. 3C. Furthermore, for the reason that the slit 31 of the tension valve 30 can be opened accurately when the surface of the gasbag 20 deforms, a chamfer angle 310 can be disposed at one side of the slit 31 that faces to the gasbag 20, as shown in FIG. 1. On the other hand, the dimension of the chamfer angle 310 can determine what extent the surface of the gasbag 20 must be deformed to let the slit 31 to be opened.

As FIGS. 1A~1B shown, atmosphere will not pass through the air hole 21 and slit 31 to enter the ink cartridge 10, if the curving degree of the surface of the gasbag is not enough to open the slit 31 of the tension valve, at that time, the gasbag 20 will start to expand as the ink is consumed or atmosphere pressure arises, in the meanwhile, the elastic element 40 will also thrust the gasbag 20 to provide a resistance force for stopping the expansion of the gasbag 20, and to generate a little negative pressure in the ink cartridge 10 at the right moment, to keep the ink in the ink cartridge 10 and not to leak form the inkjet printing head 11. When the ink is consumed continuously, the gasbag 20 will expand and deform, the silt 31 of the tension valve 30 will be opened owing to a certain degree of curvature reached by the deformation of the surface of the gasbag 20, and a little atmosphere will be released into the ink cartridge to cause the negative pressure in the ink cartridge 10 to be lowered, the gasbag shrinks again and recover to a little earlier state so as to let the slit 31 of the tension valve to be closed again. To go round and begin again, it can prevent the negative pressure in the ink cartridge 10 from being too large and failing to spray ink. On the contrary, when atmosphere lowers (such as the course of airplane conveyance), the elastic element 40 will also press the gasbag 20 to shrink so as to arise the negative pressure in the ink cartridge 10 to prevent the ink to leak from the inkjet printing head 11. So, the pressure adjuster of the present invention can adjust the negative pressure in the ink cartridge 10 two ways according to the change of the outside pressure.

Figures 4A, 4B:
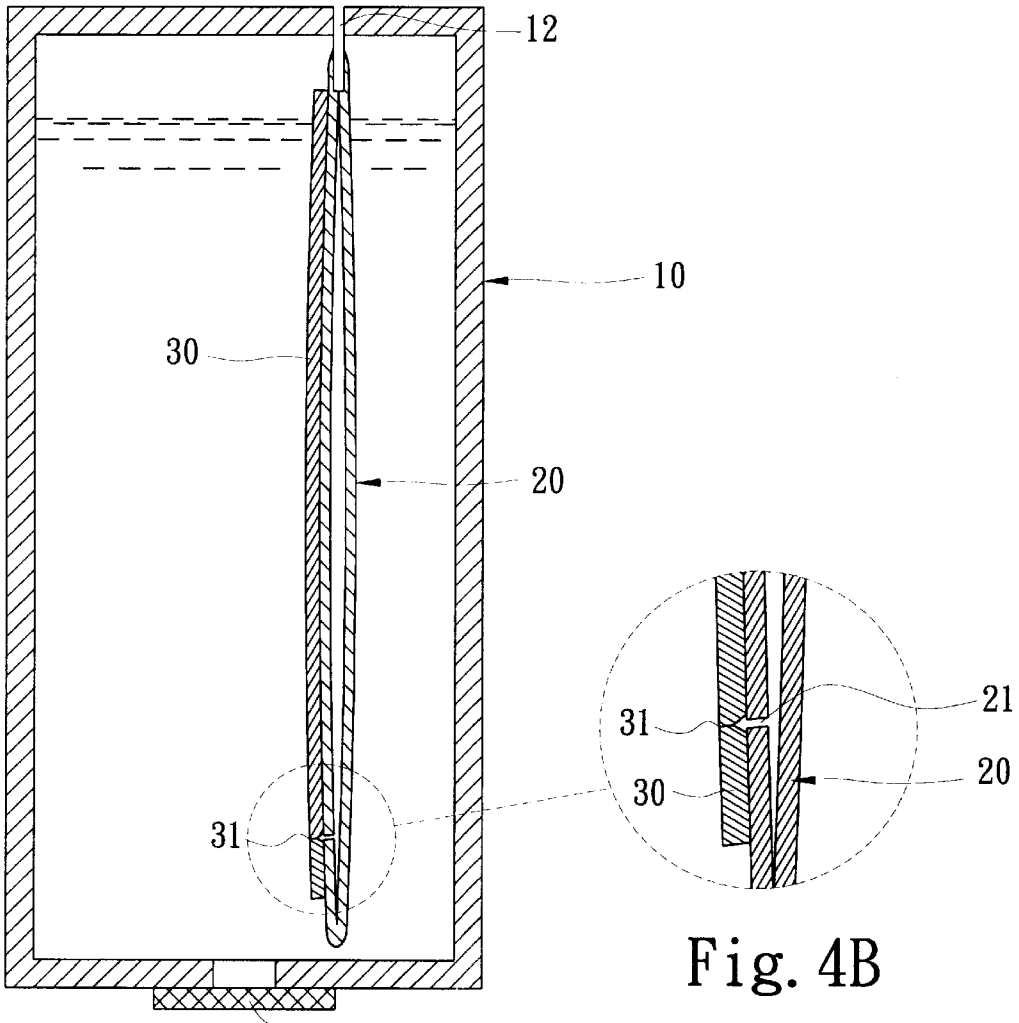
FIGS. 4A~4B is a cross sectional view of another preferred embodiment of to the present invention, showing a structure of a pressure adjustment device in an ink cartridge of an inkjet pen when a tension valve isn't opened.
Figures 5A, 5B:
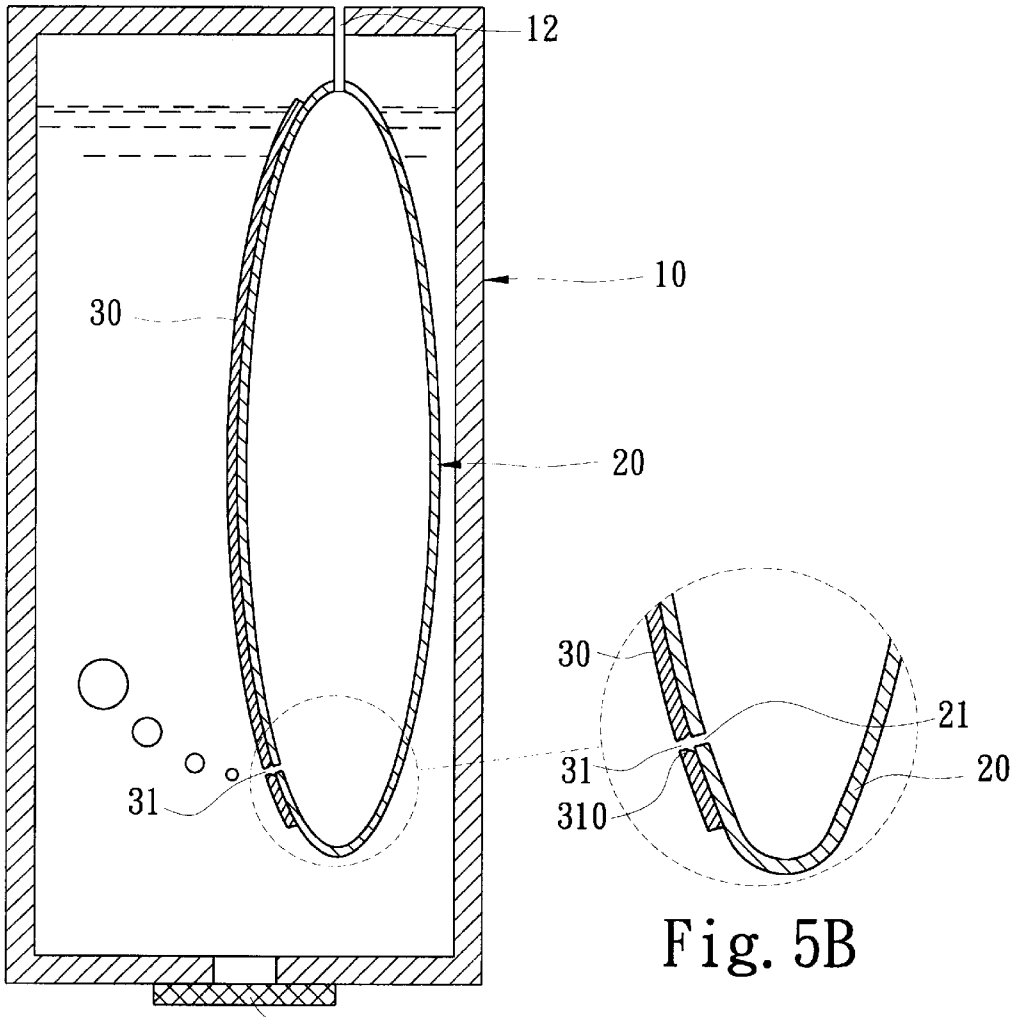
FIGS. 5A~5B is a cross sectional view of a preferred embodiment of the present invention, showing a structure of a pressure adjustment device in an ink cartridge of an inkjet pen when a tension valve is opened.

Furthermore, please refer to FIGS. 4A~4B, it shows another preferred embodiment of the present invention. In this embodiment, the elastic element 40 will not installed in a pressure adjuster, but the dimension will be increased to attach on the most part of the surface of one side of the gasbag 20, the tension valve 30 provides a proper shrinkage force to suppress the expansion of the gasbag 20 by the elasticity and plasticity of the tension valve 30 itself so as to be able to replace the elastic element 40 to compress the gasbag properly, and lower the volume occupied by the gasbag 20 in the ink cartridge 10 to provide the need negative pressure. On the contrary, when the gasbag 20 expands and deforms, the slit 31 of the tension valve 30 will be opened owing to a certain degree of curvature reached by the deformation of the surface of the gasbag 20, as shown in FIGS. 5A~5B. A little atmosphere will be released into the ink cartridge 10 to cause the negative pressure in the ink cartridge 10 to be lowered, then the gasbag 20 shrink again to recover to a little earlier state so as to let the slit 31 of the tension valve to be closed again, as shown in FIG. 4B. To go round and begin again, it can prevent the negative pressure in the ink cartridge 10 from being too large and failing to spray ink.

The present invention can solve the deficit that ink cannot be used up or the pressure can only be adjusted in one way. The design of the tension not only is rather not limited by the space, but also can lower manufacturing and assemblage expense substantially.

What is claimed is:

1. An ink pressure adjustment device for inkjet pen, said device being installed in an ink cartridge, which ink is stored therein, and being utilized to adjust negative pressure value in said ink cartridge, said device comprising:

a gasbag, being installed in said ink cartridge, the inner part of said gasbag communicating with atmosphere, at least one air hole being further disposed at one surface of said gasbag and being utilized to communicate said gasbag with the inner part of said ink cartridge;

a tension valve, being attached on the surface of said gasbag at said air hole, said tension valve having a slit, said slit being opened and closed according to a deformation of said surface after said gasbag expands, utilized to control the opening and closing of said air hole; and an elastic element, installed in said ink cartridge, being utilized to provide a resistance force when said gasbag is expanding, and generating said needed negative pressure valve by lowering a volume occupied by said gasbag in said cartridge.

2. The device of claim 1, wherein said tension valve is made of rubber.

3. The device of claim 1, wherein said tension valve is an elastic thin plate element, said slit is cut through said tension valve, and is opened and closed according to the deformation degree of the surface of said gasbag.

4. The device of claim 3, wherein said slit is a single straight-line type slit.

5. The device of claim 3, wherein said slit comprises several slits that cross each other.

6. The device of claim 1, wherein said slit further has a chamfer angle at one side thereof facing said gasbag.

7. The device of claim 1, wherein said elastic is a spring, one end thereof presses against said ink cartridge, and another end thereof is installed with a plate, said spring presses said gasbag through said plate by the elastic force of said elastic element.

8. An ink pressure adjustment device for inkjet pen, said device being installed in an ink cartridge, which ink is stored therein, and being utilized to adjust negative pressure value in said ink cartridge, said device comprising:

a gasbag, being installed in said ink cartridge, the inner part of said gasbag communicating with atmosphere, at least one air hole being further disposed at one surface of said gasbag and being utilized to communicate said gasbag with the inner part of said ink cartridge; and a tension valve, being attached on the most surface at one side of said gasbag, said tension valve being elastic and having a slit at said air hole, said slit being opened and closed according to a deformation of said surface after said gasbag expands, utilized to control the opening and closing of said air hole.

9. The device of claim 8, wherein said tension valve is made of rubber.

10. The device of claim 8, wherein said tension valve is a elastic thin plate element, said slit is cut through said tension valve, and is opened and closed according to the deformation degree of the surface of said gasbag.

11. The device of claim 10, wherein said slit is a single straight-line type slit.

12. The device of claim 10, wherein said slit comprises several slits that cross each other.

13. The device of claim 8, wherein said slit further has a chamfer angle at one side thereof facing said gasbag.

* * * * *